US009617831B2

(12) United States Patent
Jones

(10) Patent No.: US 9,617,831 B2
(45) Date of Patent: Apr. 11, 2017

(54) SYSTEM AND METHOD FOR IDENTIFYING AND PRODUCING UNCONVENTIONAL MINERALS FROM GEOLOGIC FORMATIONS

(71) Applicant: Texas Land & Cattle Company LLC, Denver, CO (US)

(72) Inventor: James S. Jones, Littleton, CO (US)

(73) Assignee: TEXAS LAND & CATTLE COMPANY, LLC, Denver, CO (US)

( * ) Notice: Subject to any disclaimer, the term of this patent is extended or adjusted under 35 U.S.C. 154(b) by 123 days.

(21) Appl. No.: 14/561,969

(22) Filed: Dec. 5, 2014

(65) Prior Publication Data

US 2015/0159471 A1 Jun. 11, 2015

Related U.S. Application Data

(60) Provisional application No. 61/912,324, filed on Dec. 5, 2013.

(51) Int. Cl.
*E21B 43/01* (2006.01)
*E21B 41/00* (2006.01)
*E21B 43/28* (2006.01)

(52) U.S. Cl.
CPC ..... *E21B 41/00* (2013.01); *E21B 43/28* (2013.01)

(58) Field of Classification Search
CPC ..... E21B 43/01; E21B 47/0001; E21B 49/001
See application file for complete search history.

(56) References Cited

U.S. PATENT DOCUMENTS 2,754,098 A * 7/1956 Heinze ..... E21B 43/285 166/303
2010/0105975 A1 4/2010 Baird
2011/0035154 A1* 2/2011 Kendall ..... C04B 7/364 702/14

FOREIGN PATENT DOCUMENTS

WO WO2012/024746 3/2012

OTHER PUBLICATIONS

International Search Report and Written Opinion, in PCT/US2014/068853, mailed Mar. 5, 2015, 9 pages.

* cited by examiner

*Primary Examiner* — Catherine Loikith
(74) *Attorney, Agent, or Firm* — Polsinelli PC

(57) ABSTRACT

The present disclosure provides a method for producing a liquid ore. The method comprises producing a liquid ore from a well in a geologic formation. The liquid ore comprises at least 250 g/L of total dissolved solids and has a pH of 6 or less. The geologic formation comprises (i) an ancient ocean sedimentary bed, (ii) a breach in the basement rock, (iii) a geothermal gradient through the geologic formation, (iv) a seismographic dim-out within the sedimentary bed, and (v) a circulation of water through the geologic formation. The ancient ocean sedimentary bed may contain at least one second well that has produced a second liquid ore, the second liquid ore comprising at least 250 g/L of total dissolved solids and having a pH of 6 or less. Also provided are methods for processing a liquid ore to obtain, for example, solid magnesium carbonate or magnesium metal.

25 Claims, 4 Drawing Sheets

SYSTEM AND METHOD FOR IDENTIFYING AND PRODUCING UNCONVENTIONAL MINERALS FROM GEOLOGIC FORMATIONS

CROSS-REFERENCE

The present application claims the benefit under 37 C.F.R. §119(e) of the filing date of provisional application U.S. Ser. No. 61/912,324, filed Dec. 5, 2013, and entitled "Unconventional Mineral Mining and Exploration," the disclosure of which is incorporated herein by reference in its entirety.

TECHNICAL FIELD

The present application generally relates to methods for natural solution mining, producing a liquid ore, and processing a liquid ore to obtain minerals and metals.

BACKGROUND

Solution mining is a process for recovering minerals in situ through wellbores into a deposit, permitting the extraction of metals and salts from an ore body without conventional drill-and-blast, open-cut or underground mining. Generally, the process initially involves drilling holes into the ore deposit. Explosive or hydraulic fracturing may be used to create open pathways in the deposit for solution to penetrate. Leaching solution may also be pumped into the deposit where contacts the ore. The solution bearing the dissolved ore content is then pumped to the surface and processed. In certain geologic formations, however, it is discovered that solution mining occurred naturally without explosives, hydraulic fracturing, or other added chemicals.

SUMMARY

Generally speaking, aspects of this disclosure involve a method for identifying the regions where natural solution mining exists, producing the naturally occurring leaching solution form those geologic formations, and processing the leaching solutions to obtain metals, salts, and other minerals. Typically brine water is a nuisance to hydrocarbon producers, and must be disposed of before processing crude oil or natural gas. As such, conventional oil and gas exploration leads one away from the geologic formations containing saturated brine water and away from geologic formations with features which may give rise to saturated brine water. It is within these issues in mind, among others, that aspects of the present disclosure were conceived.

Briefly, therefore, one aspect of the present disclosure encompasses a method for producing a liquid ore. The method comprises producing a liquid ore from a well in a geologic formation. The liquid ore comprises at least 250 g/L of total dissolved solids and has a pH of 6 or less. The geologic formation comprises (i) an ancient ocean sedimentary bed, (ii) a breach in the basement rock, (iii) a geothermal gradient through the geologic formation, (iv) a seismographic dim-out within the sedimentary bed, and (v) a circulation of water through the geologic formation.

Another aspect of the disclosure provides a method for producing liquid ore. The method comprises producing a liquid ore from a well in a geologic formation. The liquid ore comprises at least 250 g/L of total dissolved solids and has a pH of 6 or less. The well is located within the edges of an ancient ocean sedimentary bed containing at least one second well that has produced a second liquid ore. The second liquid ore comprises at least 250 g/L of total dissolved solids and has a pH of 6 or less.

A further aspect of the disclosure provides a method for processing a liquid ore. The method comprises (a) contacting a liquid ore with carbon dioxide to form a mixture. In step (b), the mixture of step (a) is contacted with a proton acceptor to form solid magnesium carbonate. In step (c), the solid magnesium carbonate is separated from the mixture of step (b). The liquid ore comprises at least 250 g/L of total dissolved solids, has a pH of 6 or less, and is produced from a well. The well may be (1) located in a geologic formation, comprising (i) an ancient ocean sedimentary bed, (ii) a breach in the basement rock, (iii) a geothermal gradient through the geologic formation, (iv) a seismographic dim-out within the sedimentary bed, and (v) a circulation of water through the geologic formation. Alternatively, the well may be (2) located within the edges of an ancient ocean sedimentary bed containing at least one second well that has produced a second liquid ore, the second liquid ore comprising at least 250 g/L of total dissolved solids and has a pH of 6 or less. In other embodiments, the well may have the characteristics of both (1) and (2).

Other features and iterations of the disclosure are described in more detail below.

DETAILED DESCRIPTION

Figure 1:
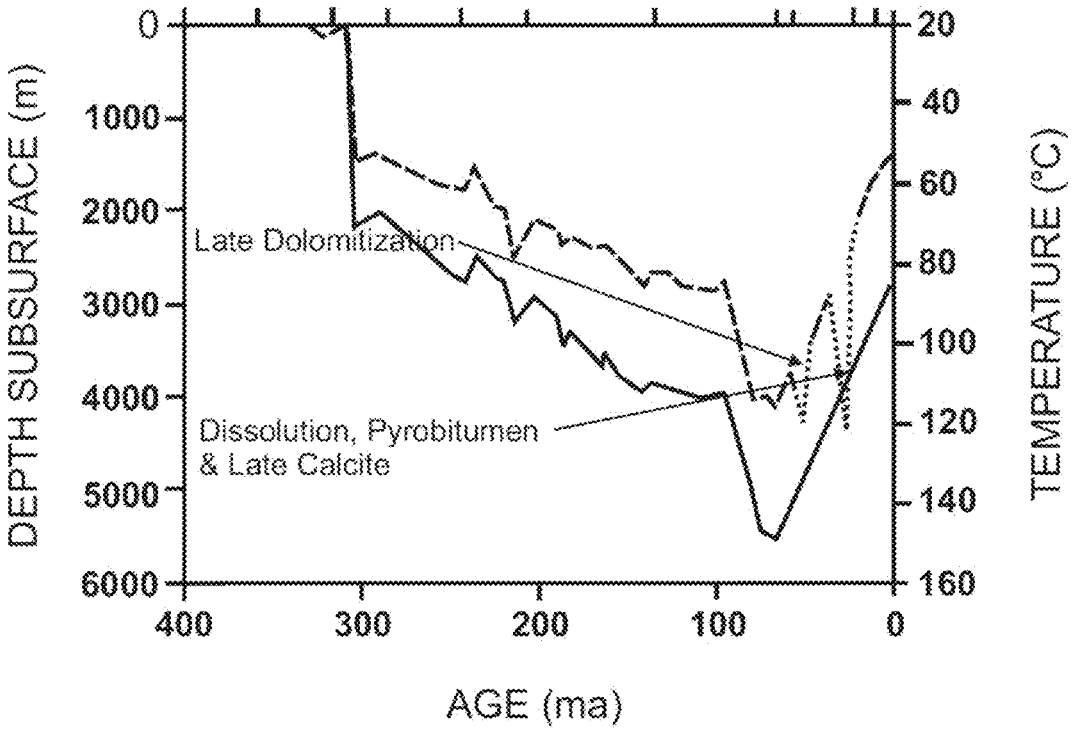
FIG. 1 shows a burial history and temperature profile with two inferred hydrothermal events at Lisbon Field. The solid black line indicates the burial history profile, the solid red line indicates the temperature profile, the dotted line indicated the inferred temperature anomalies, and the shaded area indicates residual heat retained in some of the Lisbon Field rocks.
Figure 2:
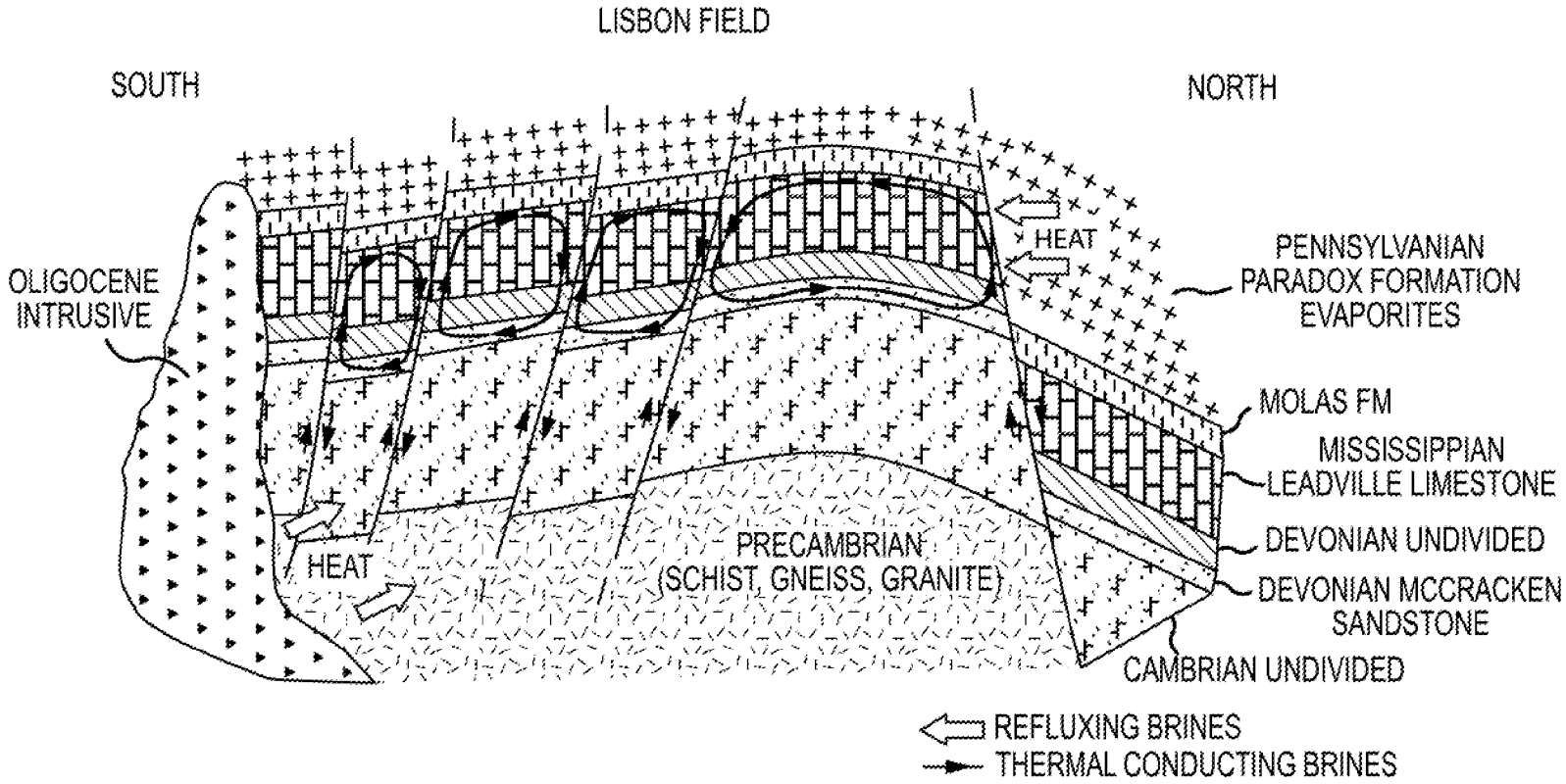
FIG. 2 depicts a conceptual diagram showing convection cells and possible heat sources for late dolomitization and dissolution. This geothermal model shows secondary porosity development in the Lisbon Field area. A similar model may be invoked in the Paradox formation of Moab, Utah, and in the Thompson Canyon and Uncompahgre Uplift Areas of Grand County, Utah.
Figure 3:
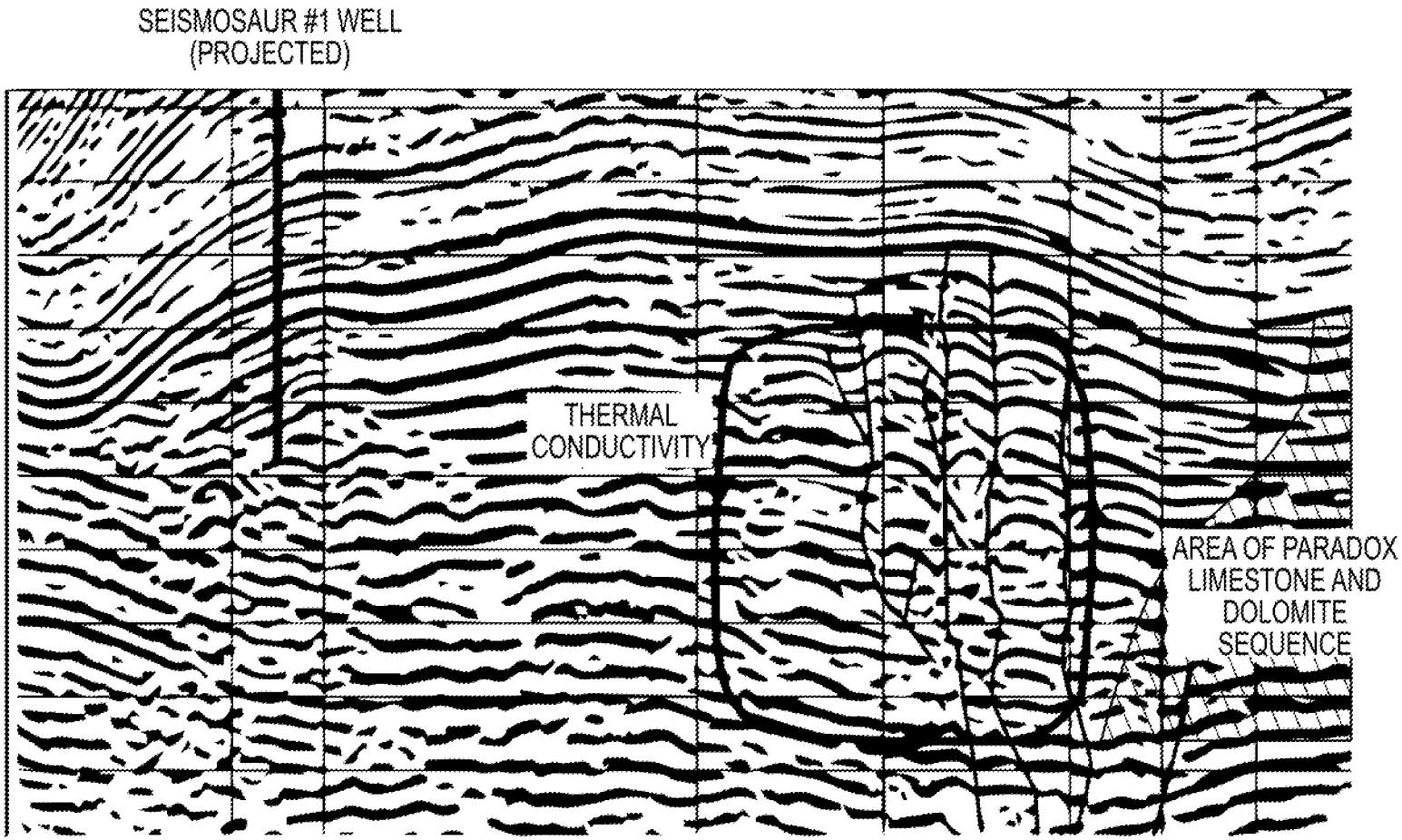
FIG. 3 shows a seismic profile in the Thompson Canyon Prospect, evidencing geothermal flows propagated along a deep-seated fault driven by an Oligocene intrusive heat source. This formation is analogous to the geothermal flow seen in the Lisbon Field located about 46 miles to the south. Water analysis of the Seismosaur 1 well indicates liquid ore under-saturated with potassium and sodium, which is very similar to the Long Canyon well where lithium and rare earth metals were detected, confirming crustal origin of the water.
Figure 4:
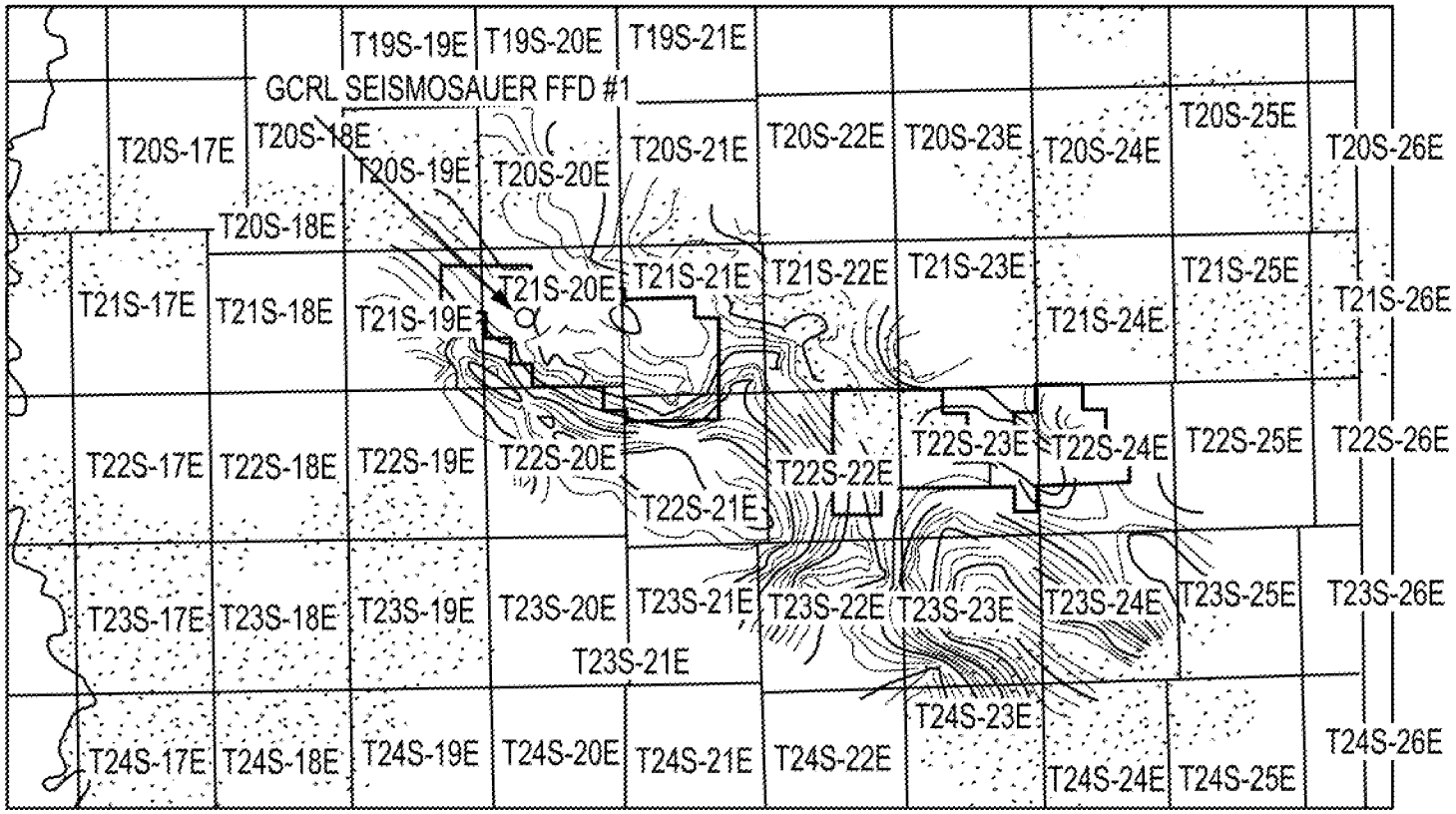
FIG. 4 shows the magnetic vertical gradient in front of the Uncompahgre Uplift and significant basement movement that embraces the area of the Seismosaur well, seen at the center.

The present disclosure provides a method for locating and obtaining brine from the ground. This brine, referred to as "liquid ore," contains about 10 to 500 times more dissolved salts, metals, and minerals than average seawater. Processing this liquid ore allows one to extract the valuable substances dissolved in it. After extraction, these dissolved substances may have equal or greater value than the same volume of crude oil.

In particular, provided herein are methods for producing and processing liquid ore. As used herein, "producing" and "production" are each defined as the operation that purposefully brings the liquid ore out of the geologic formation to the surface and prepares the liquid ore for processing. The producing step begins after the well is drilled.

This liquid ore results from natural solution mining occurring from tectonic events that breach the earth's crust and the subsequent cooling of magma by the subterranean seawater of an ancient ocean. The pressure and gasses from the magma result in hydrothermal events, which leach carbonates and strategic metals from the geologic formation in a naturally-occurring solution mining process. Seismic "dim-outs" juxtapose basement faults, representing areas of leaching. In particular, acidic water leaches the ancient ocean sedimentary bed. These events drive an in situ reaction in a natural reaction chamber deep in the earth's crust under extreme pressure and temperature, capable of retorting, leaching, and resulting in a liquid ore containing high concentrations of strategic metals originating from the earth's crust.

(I) Method for Producing a Liquid Ore

Provided herein is a method for producing a liquid ore. The method comprises producing a liquid ore from a well in a geologic formation. The liquid ore comprises at least about 250 g/L of total dissolved solids and has a pH of about 6 or less. In some embodiments, the geologic formation may comprise an (i) ancient ocean sedimentary bed, (ii) a breach in the basement rock, (iii) a geothermal gradient through the geologic formation, (iv) a seismographic dim-out within the sedimentary bed, and (v) a circulation of water through the geologic formation. In particular embodiments, the ancient ocean sedimentary bed may contain at least one second well that has produced a second liquid ore, the second liquid ore comprising at least about 250 g/L of total dissolved solids and having a pH of about 6 or less.

(a) Liquid Ore

"Liquid ore" refers to brine water obtained from a geologic formation, generally having a total dissolved solids content of at least about 250 g/L (250,000 ppm) and a pH of about 6 or less. Like solid ores, liquid ore contains minerals of value, namely strategic metals such as magnesium, strontium, and rubidium, in a matrix, which here is chiefly water. In addition to magnesium, strontium, and rubidium, liquid ore may further comprise other minerals and ions, as described in the table below. The ranges exemplify concentrations of the component in the liquid ore, when present. For comparison, the average mineral content of surface seawater is also shown.

TABLE 1

Exemplary components of a liquid ore

| Component* | Concentration (mg/L) Low | Concentration (mg/L) High | Concentration in Seawater |
|---|---|---|---|
| Aluminum (Al) | 0.2 | 100 | — |
| Barium (Ba) | 100 | 150 | — |
| Ammonia ($NH_3$) | 849 | 1,330 | — |
| Bicarbonate ($HCO_3^-$) | 110 | 1,600 | 126 |
| Boron/Borate ($B/B_2O_5^{4-}$) | 9 | 2,000 | 26 |
| Bromine (Br) | 1,150 | 6,100 | 673 |
| Calcium (Ca) | 240 | 135,200 | 4,119 |
| Carbonate ($CO_3^{2-}$) | 200 | 2,200 | — |
| Chlorine (Cl) | 29,800 | 292,000 | 19,353 |
| Fluorine (F) | 25 | 73 | 1 |
| Iodine (I) | 42 | 450 | — |

TABLE 1-continued

Exemplary components of a liquid ore

| Component* | Concentration (mg/L) Low | Concentration (mg/L) High | Concentration in Seawater |
|---|---|---|---|
| Iron (Fe) | 90 | 1,210 | — |
| Lithium (Li) | 18 | 500 | — |
| Magnesium (Mg) | 266 | 47,789 | 1,284 |
| Manganese (Mn) | 85 | 260 | — |
| Phosphate ($PO_4^{3-}$) | 15 | 2,000 | — |
| Potassium (K) | 4,420 | 45,475 | 399 |
| Rare Earth Elements (REEs)** | 100 | 400 | — |
| Rubidium (Rb) | 6 | 700 | — |
| Sodium (Na) | 3,420 | 140,484 | 10,781 |
| Strontium (Sr) | 1,300 | 3,510 | 8 |
| Sulfate ($SO_4^{2-}$) | 4 | 12,800 | 2,712 |
| Zinc (Zn) | 60 | 300 | — |
| Total Dissolved Solids | 250,000 | 443,000 | 35,169 |

*Based on dissolution in acidic aqueous medium, most of the components are present in the liquid ore in a charged or ionized form. For example ammonia with mostly be in the form of an ammonium ion ($NH_4^+$). However, for sake of simplicity, components are generally listed in their neutral or elemental forms, which one of skill in the art would recognize as representing the concentration of that component in all forms - neutral or charged.

**REEs are defined below in section (I)(a)(v).

As illustrated above in Table 1, in some embodiments, the liquid ore may contain up to 12.7 times more bicarbonate than seawater, as well as up to 77 times more boron/borate, 9 times more bromine, 32.8 times more calcium, 15 times more chlorine, 73 times more fluorine, 37 times more magnesium, 114 times more potassium, 13 times more sodium, 439 times more strontium, 4.7 times more sulfate, and 7-12.6 times more total dissolved solids than seawater. Any given sample of liquid ore may contain one or more of the foregoing ions. In addition to these, the liquid ore may contain significant amounts of constituents not detectible in seawater, for example aluminum, barium, ammonia, carbonate, iodine, iron, lithium, manganese, phosphate, REEs, rubidium, and zinc.

In other embodiments, the liquid ore may also comprise trace amounts of other minerals, such as copper, gallium, lead, nitrate, selenium, thorium-232 ($^{232}Th$), and zirconium, which are also not present in seawater.

(i) Strategic Metal

"Strategic metal" refers to metals required for the national defense of a country, but are threatened by supply disruptions due to limited domestic production. "Minor metal" refers to the total global production levels of the metal, whereas "strategic metal" refers to the end-use of the metal as well as its susceptibility to supply disruption due to the geographic location of key producers. For example, a metal is more likely to be classified as a strategic metal when one or more of the following factors are met: high scarcity (<0.1 ppm crustal concentration), high production concentration (>75% in the top three countries), high reserve base distribution (>75% in the top three countries), low political stability. The strategic metals include antimony (Sb), arsenic (As), beryllium (Be), bismuth (Bi), cadmium (Cd), chromium (Cr), cobalt (Co), gallium (Ga), germanium (Ge), hafnium (Hf), indium (In), lithium (Li), magnesium (Mg), manganese (Mn), mercury (Hg), molybdenum (Mo), niobium (Nb), Rare Earth Elements (REEs), rhenium (Re), rhodium (Rh), selenium (Se), strontium (Sr), tantalum (Ta), tellurium (Te), thallium (Tl), titanium (Ti), tungsten (W), vanadium (V), and zirconium (Zr). Subgroups within the list of strategic minerals include the platinum group metals, irdium (Ir), osmium (Os), and rhodium (Rh), and the REEs, which are described in detail below at section (I)(a)(v). In some embodiments, the strategic metals retrieved from the liquid ore are selected from the group consisting of magnesium, strontium, rubidium, and REEs.

(ii) Magnesium

Magnesium within the liquid ore may be obtained from a geologic formation comprising a mineral salt. Suitable examples of magnesium salts include, for example, magnesium carbonate ($MgCO_3$), magnesium sulfate ($MgSO_4$), magnesium chloride ($MgCl_2$), magnesium hydroxide ($Mg(OH)_2$, brucite), magnesium oxide (MgO, magnesia), or magnesium silicate ($MgSiO_3$). Magnesium carbonate may be in the form of dolomite ($CaMg(CO_3)_2$), magnesite ($MgCO_3$), the dihydrate barringtonite ($MgCO_3.2H_2O$), the trihydate nesquehonite ($MgCO_3.3H_2O$, $Mg(OH)(HCO_3).2H_2O$), or the pentahydrate lansfordite ($MgCO_3.5H_2O$), artinite ($MgCO_3.Mg(OH)_2.3H_2O$), hydromagnesite ($4MgCO_3.Mg(OH)_2.4H_2O$), or dypingite ($4MgCO_3.Mg(OH)_2.5H_2O$). Magnesium chloride may be in the form of carnallite ($KMgCl_3.6H_2O$) or bischofite ($MgCl_6.6H_2O$). Magnesium sulfate may be in the form of Epsom salts ($MgSO_4.7H_2O$), kainite ($KMg(SO_4)Cl.3H_2O$), kieserite ($MgSO_4.H_2O$), langbeinite ($K_2Mg_2(SO_4)_3$), or polyhalite ($KMg(SO_4)Cl.3H_2O$). Magnesium silicate may be in the form of talc ($H_2Mg_3(SiO_3)_4$, $Mg_2Si_4O_{10}(OH)_2$), baileychlore ($(Zn,Fe^{+2},Al,Mg)_6(Al,Si)_4O_{10}(O,OH)_8$), chamosite ($(Fe,Mg)_5Al(Si_3Al)O_{10}(OH)_8$), clinochlore ($(Mg_5Al)(AlSi_3)O_{10}(OH)_8$), gonyerite ($(Mn,Mg)_5(Fe^{+3})_2Si_3O_{10}(OH)_8$), nimite ($(Ni,Mg,Al)_6(Si,Al)_4O_{10}(OH)_8$), monticellite ($CaMgSiO_4$), odinite ($(Fe,Mg,Al,Fe,Ti,Mn)_{2.4}(Al,Si)_2O_5OH_4$), olivine ($(Mg,Fe)_2SiO_4$, peridot, chrysolite), orthochamosite ($(Fe^{+2},Mg,Fe^{+3})_5Al(Si_3Al)O_{10}(O,OH)_8$), ripidolite ($(Mg,Fe,Al)_6(Al,Si)_4O_{10}(OH)_8$), or sudoite ($Mg_2(Al,Fe)_3Si_3AlO_{10}(OH)_8$).

In general, the liquid ore comprises from about 250 mg/L to about 50,000 mg/L of Mg. In various embodiments, the concentration of Mg in the liquid ore may range from about 250 mg/L to about 1,000 mg/L, from about 1,000 mg/L to about 1,500 mg/L, from about 1,500 mg/L to about 2,500 mg/L, from about 2,500 mg/L to about 5,000 mg/L, from about 5,000 mg/L to about 10,000 mg/L, from about 10,000 mg/L to about 20,000 mg/L, from about 20,000 mg/L to about 30,000 mg/L, from about 30,000 mg/L to about 40,000 mg/L, or from about 40,000 mg/L to about 50,000 mg/L. In other words, in various embodiments the concentration of Mg in the liquid ore may range from about 0.250 g/L to about 1.0 g/L, from about 1.0 g/L to about 1.5 g/L, from about 1.5 g/L to about 2.5 g/L, from about 2.5 g/L to about 5.0 g/L, from about 5.0 g/L to about 10 g/L, from about 10 g/L to about 20 g/L, from about 20 g/L to about 30 g/L, from about 30 g/L to about 40 g/L, or from about 40 g/L to about 50 g/L.

In exemplary embodiments, the liquid ore may comprise at least about 10,000 mg/L Mg (10 g/L Mg), such as at least about 20,000 mg/L Mg (20 g/L Mg).

In some embodiments, the liquid ore may comprise less than about 50,000 mg/L of Mg.

(iii) Strontium

The liquid ore may further comprise strontium. Strontium is useful in a variety of applications, including for example pyrotechnics, nuclear fuel, glass dopant, zinc refinement, and optics. In general, when present, the liquid ore may comprise from about 1,000 mg/L to about 4,000 mg/L of Sr.

In various embodiments, the concentration of Sr in the liquid ore may range from about 1,000 mg/L to about 1,500 mg/L, from about 1,500 mg/L to about 2,000 mg/L, from about 2,000 mg/L to about 2,500 mg/L, from about 2,500 mg/L to about 3,000 mg/L, from about 3,000 mg/L to about 3,500 mg/L, or from about 3,500 mg/L to about 4,000 mg/L.

In some embodiments, the concentration of Sr in the liquid ore may be greater than about 1,000 mg/L.

In some embodiments, the concentration of Sr in the liquid ore may be less than about 4,000 mg/L.

(vi) Rubidium

The liquid ore may further comprise rubidium. Rubidium is useful in a variety of applications, including for example pyrotechnics, thermoelectric generation, atomic clocks (including rubidium standards and oscillators), Bose-Einstein condensation, the working fluid in vapor turbines, vacuum tubes getters, photocells, glass dopants, superoxide production, atomic magnetometers, and positron emission tomography (PET). In general, when present, the liquid ore may comprise from about 5 mg/L to about 1,000 mg/L of Rb.

In various embodiments, the concentration of Rb in the liquid ore may range from about 5 mg/L to about 10 mg/L, from about 10 mg/L to about 50 mg/L, from about 50 mg/L to about 100 mg/L, from about 100 mg/L to about 250 mg/L, from about 250 mg/L to about 500 mg/L, or from about 500 mg/L to about 1,000 mg/L.

In certain embodiments, the liquid ore may comprise from about 600 mg/L to about 750 mg/L Rb.

In some embodiments, the concentration of Rb in the liquid ore may be greater than about 5 mg/L.

In some embodiments, the concentration of Rb in the liquid ore may be less than about 1,000 mg/L.

(v) Rare Earth Elements (REEs)

The liquid ore may further comprise at least one rare earth element. Rare earth elements (REE), also called rare earth metals, consist of the fifteen lanthanides plus scandium and yttrium. The lanthanide elements consist of lanthanum, cerium, praseodymium, neodymium, promethium, samarium, europium, gadolinium, terbium, dysprosium, holmium, erbium, thulium, ytterbium, and lutetium. The REEs may be divided into the light-group elements (atomic numbers 57-64) and the heavy-group elements (atomic number 65-71).

The REE may be ionized. The REE may have an oxidation state of 2, 3, or 4. The REE ion may be $Sc^{3+}$, $Y^{3+}$, $La^{3+}$, $Ce^{3+}$, $Ce^{4+}$, $Pr^{3+}$, $Pr^{4+}$, $Nd^{3+}$, $Sm^{2+}$, $Sm^{3+}$, $Eu^{2+}$, $Eu^{3+}$, $Gd^{3+}$, $Tb^{3+}$, $Tb^{4+}$, $Dy^{3+}$, $Ho^{3+}$, $Er^{3+}$, $Tm^{2+}$, $Tm^{3+}$, $Yb^{2+}$, $Yb^{3+}$, and $Lu^{3+}$. In a particular embodiment, the REE ion may be selected from the group consisting of $La^{3+}$, $Ce^{3+}$, $Pr^{3+}$, $Nd^{3+}$, $Sm^{3+}$, $Eu^{3+}$, $Gd^{3+}$, $Tb^{3+}$, $Dy^{3+}$, $Ho^{3+}$, $Er^{3+}$, $Tm^{3+}$, $Yb^{3+}$, and $Lu^{3+}$.

In general, when present, the liquid ore may comprise from about 5 mg/L to about 1,000 mg/L of REEs. In various embodiments, the concentration of REEs in the liquid ore may range from about 5 mg/L to about 10 mg/L, from about 10 mg/L to about 50 mg/L, from about 50 mg/L to about 100 mg/L, from about 100 mg/L to about 250 mg/L, from about 250 mg/L to about 500 mg/L, or from about 500 mg/L to about 1,000 mg/L. In certain embodiments, the liquid ore may comprise from about 600 mg/L to about 750 mg/L REEs.

REEs are useful in many technology industries. Table 2 provides relative costs and exemplary applications for each REE.

TABLE 2

Relative costs and non-limiting exemplary applications for REEs

| Element | Symbol | Relative Cost | Exemplary Application |
|---|---|---|---|
| Lanthanum | La | Cheap | Hybrid car batteries, camera lenses, fiber optics, high refractive index glass, flint, hydrogen storage, fluid catalytic cracking catalyst for oil refineries |
| Cerium | Ce | Cheap | Glass polish, catalytic converters, chemical oxidizing agent, polishing powder, yellow colors in glass and ceramics, catalyst for self-cleaning ovens, fluid catalytic cracking catalyst for oil refineries, ferrocerium flints for lighters |
| Praseodymium | Pr | Cheap | Magnets, plastic manufacturing, lasers, core material for carbon arc lighting, colorant in glasses and enamels, additive in didymium glass used in welding goggles, ferrocerium firesteel (flint) products |
| Neodymium | Nd | Cheap | Magnets, wind turbines, electric motors, lasers, violet colors in glass and ceramics, ceramic capacitors |
| Promethium | Pm | — | Phosphor, compact fluorescent lights (CFLs), nuclear batteries |
| Europium | Eu | $250-$1000/kg | Red and blue phosphors, lasers, mercury-vapor lamps, nuclear magnetic resonance (NMR) relaxation agent |
| Gadolinium | Gd | — | Magnets, nuclear reactor control, magnetic resonance imaging (MRI) contrast agent, high refractive index glass or garnets, lasers, X-ray tubes, computer memory, neutron capture, NMR relaxation agent |
| Terbium | Tb | — | Low-energy light bulbs, flat panel displays, green phosphor, lasers, fluorescent lamps |
| Dysprosium | Dy | Cheap | Magnets, sonar sensors, semiconductors, laser diodes |
| Holmium | Ho | — | Lasers |
| Erbium | Er | ~$700/kg | Laser amplifiers for optical fiber technology, vanadium steel |
| Thulium | Tm | Expensive | Lighting, portable X-ray machines |
| Ytterbium | Yb | — | Infrared lasers, chemical reducing agent |
| Lutetium | Lu | Expensive | Lasers, lenses, positron emission tomography (PET) scan detectors, high refractive index glass |
| Yttrium | Y | — | fighter jet engines, jewelry, yttrium aluminum garnet (YAG) laser, yttrium vanadate ($YVO_4$) as host for europium in television red phosphor, yttrium-barium-copper-oxide (YBCO) high-temperature superconductors, yttrium iron garnet (YIG) microwave filters, energy-efficient light bulbs |
| Samarium | Sm | Cheap | Magnets, electronic miniaturization, maser, X-ray laser, neutron capture |
| Scandium | Sc | — | High-strength and lightweight objects, fighter jet frames, mercury-vapor lamps |

(vi) Physical Properties of Liquid Ore

Generally, liquid ore is acidic and has a pH of less than about 7. In exemplary embodiments, the liquid ore may have a pH of about 6 or less, such as about 5 or less, about 4 or less, or about 3 or less.

Liquid ore also generally comprises at least about 250 g/L total dissolved solids, such as from about 250 g/L to about 500 g/L total dissolved solids.

In various embodiments, the concentration of total dissolved solids in the liquid or may range from about 250 g/L to about 300 g/L, from about 300 g/L to about 350 g/L, from about 350 g/L to about 400 g/L, from about 400 g/L to about 450 g/L, or from about 450 g/L to about 500 g/L.

In some embodiments, the concentration of total dissolved solids in the liquid ore may be greater than about 250 g/L.

In some embodiments, the concentration of total dissolved solids in the liquid ore may be less than about 500 g/L.

In part because of the high concentrations of total dissolved solids, the liquid ore may have a specific gravity greater than about 1.0 g/mL as measured at 25° C.

In various embodiments, the specific gravity may be about 1.1 g/mL, about 1.2 g/mL, about 1.3 g/mL, about 1.4 g/mL, about 1.5 g/mL, about 1.6 g/mL, about 1.7 g/mL, or about 1.8 g/m L.

In some embodiments, the specific gravity the liquid ore may be greater than about 1.0 g/m L.

In some embodiments, the specific gravity of the liquid ore may be less than about 1.8 g/m L.

(b) Wells

The method for producing a liquid ore involves a well, either through identification of an existing well by methods described herein, or by drilling a well at a location within a geologic formation as described herein.

In various embodiments, the method may further comprise drilling the well in the geologic formation before producing the liquid ore.

In other embodiments, the well or the geologic formation may be preselected using the criteria described below in section (I)(c).

In general, a well is formed from a wellbore of about 5 to about 50 inches (about 127.0 mm to about 914.4 mm) in diameter drilled into the Earth with a drilling rig that rotates a drill string with a drill bit attached. After the wellbore is drilled, sections of steel pipe ("casing") slightly smaller in diameter than the wellbore are placed in the hole. Concrete may be placed between the outside of the casing and the wellbore. The casing provides structural integrity to the newly drilled wellbore and isolates potentially dangerous high pressure zones from each other and from the surface. With these zones safely encased, the well may be drilled deeper into potentially more unstable and violent sections with a smaller bit, which may also be encased with a smaller-sized casing. A well may comprise one or more sets of subsequently smaller hole sizes drilled inside one another.

The drill bit, aided by the weight of thick walled pipes ("drill collars") cuts into the rock. The drill bit may cause the rock to disintegrate by compressive failure or shear slices off the rock as the bit turns. Drilling fluid ("mud") is pumped into the drill pipe and exits at the drill bit. Drilling mud is a mixture of fluids and solids tailored to provide the physical and chemical characteristics for safely drilling the well. Particular functions of the drilling mud include cooling the bit, lifting rock cuttings to the surface, preventing destabilization of the rock in the wellbore walls, and overcoming the pressure of fluids inside the rock so that these fluids do not enter the wellbore.

Rock "cuttings" are swept up by the drilling fluid as it circulates back to surface outside the drill pipe. The fluid then goes through "shakers" which strain the cuttings from the good fluid which is returned to the pit. The pit may be lined, for example with a thick plastic liner. Watching for abnormalities in the returning cuttings and monitoring pit volume or rate of returning fluid are imperative to catch "kicks" early. A "kick" is when the pressure from the geologic formation at the depth of the bit is more than the hydrostatic head of the mud above. If not controlled temporarily by closing the blowout preventers and ultimately by increasing the density of the drilling fluid, the pressure may allow fluids from the geologic formation and mud to come up uncontrollably.

The pipe or drill string to which the bit is attached is gradually lengthened by screwing in ("tripping") additional 30-foot (9-meter) sections ("joints") of pipe under the kelly or topdrive at the surface. By creating stands of multiple joints, joints may be combined for more efficient tripping when pulling from the hole. A conventional triple, for example, would pull pipe from the hole three joints at a time and stack them in the derrick. "Super singles" trip pipe one at a time, laying it out on racks as they go. The drilling rig may contain the equipment to circulate the drilling fluid, hoist and turn the pipe, control downhole, remove cuttings from the drilling fluid, and generate on-site power for these operations.

After drilling and encasing the well, the well is "completed," wherein it is enabled to produce liquid ore. In a cased-hole completion, a portion of the casing passing through the production zone may be perforated to provide a path for the liquid ore to flow from the surrounding rock into the production tubing. In an open-hole completion, "sand screens" or a "gravel pack" may be installed in the last drilled, uncased reservoir section. These screens maintain structural integrity of the wellbore in the absence of casing, while still allowing liquid ore to flow from the reservoir into the wellbore. Screens also control the migration of formation sands into production tube and surface equipment, which may cause washouts and other problems, particularly from unconsolidated sand formations of offshore fields.

After a flow path is made, acids and fracturing fluids may optionally be pumped into the well to fracture, clean, prepare, or stimulate the reservoir rock to produce liquid ore into the wellbore. Generally, acids and fracturing fluids are not needed for liquid ore production because the liquid ore is already acidic and has leached minerals from the geologic formation. The area above the reservoir section of the well may be packed inside the casing and connected to the surface via a smaller diameter pipe ("tubing"). This arrangement provides a redundant barrier to leaks of liquid ore and allows damaged sections of casing to be replaced as needed. Also, the smaller cross-sectional area of the tubing produces reservoir fluids at an increased velocity to minimize liquid fallback that would create additional back pressure, and shields the casing from corrosive well fluids, such as the liquid ore itself.

In many wells, the natural pressure of the subsurface reservoir may be high enough for the liquid ore to come to the surface. In low permeability reservoirs or in depleted fields, where the pressures have been lowered by other producing wells, pressure may not be high enough to push the liquid ore to the surface. Installing a smaller-diameter tubing and using artificial lift methods, including downhole pumps, gas lift, and surface pump jacks, may help production. Alternatively, multiple packer systems with frac ports or port collars in an all-in-one system may also aid production, especially for horizontal wells, allowing casings to run into the lateral zone with proper packer/frac port placement.

In the production stage of a well, liquid ore is purposefully produced. At this stage, any producing step of a method disclosed herein may be applied. The rigs used to drill and complete the well have been removed, and the top may be outfitted with a collection of valves ("Christmas tree" or "production tree"). These valves regulate pressures, control flows, and allow access to the wellbore in case of further completion work. From the outlet valve of the production tree, the flow may be connected to a distribution network of pipelines, tanks, collection pools, and the like to supply the product to mineral isolation facilities and processes, as described below in section (II).

As long as the pressure in the reservoir remains high enough, the production tree may be sufficient to produce the well. If the pressure depletes and the well remains economically viable, an artificial lift method may be employed. Workovers may be made in older wells, including the installation of smaller-diameter tubing, scale or paraffin removal, acid matrix jobs, or completing new zones of interest in a shallower reservoir. Such remedial work may be performed using a workover rigs ("pulling units," "completion rigs," or "service rigs"). Depending on the type of lift system and wellhead, a rod rig or flushby may be used to change a pump without pulling the tubing.

Enhanced recovery methods such as water flooding, steam flooding, or $CO_2$ flooding may be used to increase reservoir pressure and provide a "sweep" effect to push liquid ore from the reservoir. $CO_2$ flooding is particularly advantageous because it provides $CO_2$ to the liquid ore to produce magnesium carbonate (see below at section(II)(a)). Such methods may use injection wells, such as old production wells in a carefully determined pattern, and may be used when facing reservoir pressure depletion, high viscosity, or to increase the rate of production.

A well reaches an economic limit when its most efficient production rate does not cover operating expenses, including taxes. When the economic limit is raised, the life of the well is shortened and proven liquid ore reserves are lost. Conversely, when the economic limit is lowered, the life of the well is lengthened. When the economic limit is reached, the well becomes a liability and may be abandoned. In this process, tubing is removed from the well and sections of wellbore may be filled with concrete to isolate the flow path between gas and liquid ore zones from each other, as well as the surface. The surface around the wellhead may be excavated, and the wellhead and casing cut off, a cap welded in place, and buried. In some instances, temporary plugs may be placed downhole and locks attached to the wellhead to prevent tampering.

Wells may be classified according to their purpose in developing a resource. For example, "wildcat wells" are drilled outside of known oil or gas fields. "Exploration wells" are drilled for exploratory (information-gathering) purposes in a new area. "Appraisal wells" are used to assess characteristics, such as flow rate, of a proven accumulation. "Production wells" are drilled for producing liquid ore, once the producing structure and characteristics are determined within the geologic formation.

Active wells may be further categorized. "Oil producers" predominantly produce liquid hydrocarbons, but typically with some associated gas. "Gas producers" produce almost entirely gaseous hydrocarbons. "Liquid ore producers" predominantly produce liquid ore, as described above. "Water injectors" inject water into the geologic formation to maintain reservoir pressure. "Aquifer producers" produce water for reinjection to manage pressure. "Gas injectors" inject gas into the reservoir often as a means of disposal or sequestering for later production, but also to maintain reservoir pressure.

(c) Geologic Formation

The method for producing a liquid ore occurs within a geologic formation. The geologic formation may comprise an (i) ancient ocean sedimentary bed, (ii) a breach in the basement rock, (iii) a geothermal gradient through the geologic formation, (iv) a seismographic dim-out within the sedimentary bed, and (v) a circulation of water through the geologic formation.

In particular embodiments, the ancient ocean sedimentary bed may contain at least one second well that has produced a second liquid ore, the second liquid ore comprising at least about 250 g/L of total dissolved solids and having a pH of about 6 or less.

In some embodiments, the geologic formation may be preselected using the characteristics of the geologic formation, such as an ancient ocean sedimentary bed, a breach in the basement rock, a geothermal gradient through the geologic formation, a seismographic dim-out within the sedimentary bed, a circulation of water through the geologic formation, and any combination of the foregoing. That is, the features described above may be used for choosing a geologic formation from which to produce liquid ore before the production of the liquid ore has begun.

In other embodiments, the geologic formation may be preselected using the characteristics of the geologic formation, such as an ancient ocean sedimentary bed containing at least one second well that has produced a second liquid ore, the second liquid ore comprising at least about 250 g/L of total dissolved solids and having a pH of about 6 or less.

(i) Ancient Ocean Sedimentary Bed

The geologic formation comprises an ancient ocean sedimentary bed; that is, a location within the earth's crust believed to once have been an ocean floor. The rise and fall of sea levels, possibly caused by the building and offsetting of ice, has provided an evaporitic cycle of salt and clastic material. Repetition of these evaporitic cycles over time has deposited alternating layers of shale, dolomite, anhydrite, and other evaporites.

In some embodiments, the geologic formation may be preselected based on the geologic formation comprising an ancient ocean sedimentary bed.

As a non-limiting example, the Paradox Inter-salt clastic play lies along a northwest-by-southeast direction from Green River, Utah to La Sal Junction, Utah. The Paradox Formation is Pennsylvanian in age and is characterized by a series of 23 evaporatic cycles, seen as cross-sections through the prospect. Organic-rich shales and dolomites were deposited from the Silverton Delta between the basin and the sea. These clastic intervals are about 21,000 feet deep. Significant hydrocarbons within black shale are sandwiched between layers of dolomite and anhydrite. A breach in the basement rock of this ancient ocean sedimentary bed, along with a geothermal gradient, a seismographic dim-out, and a circulation of water within the Paradox formation, indicate the presence of liquid ore. Also found with the Paradox formation are gas condensate in the northern extremity and oil predominantly to the west and south. Natural gas is also generally found along the eastern edge of the play where the Paradox formation is at greater depths.

(ii) Breach in the Basement Rock

The geologic formation further comprises a breach in the basement rock. In geology, "basement" and "crystalline basement" define rocks below the sedimentary bed, particularly metamorphic and igneous rocks. The sedimentary bed on top of the basement may also be called a "cover" or "sedimentary cover." The breach may be indicated seismographically or magnetically.

In some embodiments, the geologic formation may be preselected based on the geologic formation comprising a breach in the basement rock.

(1) Seismology

In various embodiments, the breach may be indicated by seismography. Without wishing to be bound by theory, seismology may provide a high resolution map of acoustic impedance contrasts at depths of up to 10 km within the subsurface. When combined with various data processing techniques and other geophysical tools, a geological model of the formation may be built. Particularly in hydrocarbon exploration, the features of petroleum reservoir are delineated: the source rock, the reservoir rock, the seal and trap.

"Reflection seismology" or "seismic reflection" estimates the properties of the Earth's subsurface from reflected seismic waves. The method may use a controlled seismic source of energy, such as dynamite/Tovex™, a specialized air gun, or a seismic vibrator (e.g., Vibroseis™). Land geometries are not limited to narrow paths of acquisition, meaning that a wide range of offsets and azimuths may be acquired. The rate of production may be controlled by how fast the source is fired and then moved to the next source location. Multiple seismic sources may be used simultaneously to increase survey efficiency, for example by independent simultaneous sweeping (ISS). If repeated over time, a 4D model may be constructed to observe reservoir depletion during production and to identify barriers to flow that may not be easily detectable in a 3D model.

Seismic waves are mechanical perturbations that travel in the Earth at a speed governed by acoustic impedance (or seismic impedance, Z) of the medium. When a seismic wave encounters an interface between materials with different acoustic impedances, some wave energy reflects off the interface and some refracts through the interface. Generally, the seismic reflection technique consists of generating seismic waves and measuring the time taken for the waves to travel from the source, reflect off an interface and be detected by an array of receivers ("geophones") at the surface.

"Travel time" is the time taken for a reflection from a particular boundary to arrive at the geophone. If the seismic wave velocity in the rock is known, then the travel time may be used to estimate the depth to the reflector. For a simple vertically traveling wave, the travel time from the surface to the reflector and back is two-way time (TWT). Knowing the travel times from the source to various receivers, and the velocity of the seismic waves, the pathways of the waves may be reconstructed to build an image of the subsurface.

A "reflection event" is a series of apparently related reflections on several seismograms. An event on the seismic record that has incurred more than one reflection is called a "multiple." Multiples may be short-path (peg-leg) or long-path, depending upon whether they interfere with primary reflections or not.

The reflection and transmission coefficients, which govern the amplitude of each reflection, may vary with the angle of incidence and may be used to obtain information about, among many other things, the fluid content (oil, gas, or liquid ore) of the rock. Workable approximations to the Zoeppritz equations facilitate practical use of non-normal incidence phenomena, known as amplitude-versus-offset (AVO). The Shuey equation is the 3-term simplification of the Zoeppritz equations, and the Shuey approximation is a further 2-term simplification valid for angles of incidence less than 30°.

In addition to reflections off interfaces, other detectable—and typically unwanted—seismic responses include airwaves, Rayleigh waves, Scholte waves, head waves, and cultural noise. Airwaves travel directly from the source to the receiver at the speed of sound in air. Rayleigh waves, or "ground roll," typically propagate at the earth-air interface. Low velocity, low frequency, and high amplitude Rayleigh waves may be present on a seismic record and may obscure the signal and degrade overall data quality if not accounted for. Scholte waves are similar to a ground roll, occurring at the seafloor at the fluid-solid interface. Head waves refract at an interface, propagate along the interface within the lower medium, and disturb the upper medium as detected on the surface. Cultural noise includes noise from planes, helicopters, and electrical pylons.

Seismic data may be processed using deconvolution, common-midpoint (CMP) stacking, seismic migration, and seismic attribute analysis. Deconvolution extracts the reflectivity series of the Earth assuming that a seismic trace is just the reflectivity series of the Earth convolved with distorting filters. This process improves temporal resolution by collapsing the seismic wavelet, but it is generally non-unique. Deconvolution operations may be cascaded, with each individual deconvolution designed to remove a particular type of distortion.

CMP stacking uses numerous sample times at different offsets at the same subsurface location, allowing the construction of a group of traces with a range of offsets that sample the same subsurface location known as a "common midpoint gather." The average amplitude is calculated along a time sample, significantly lowering random noise but also losing information about the relationship between seismic amplitude and offset. Other processes that may be applied before CMP stacking are a statics correction and a residual statics correction. A "statics correction" may be applied to land seismic data to correct for the elevation differences between the shot and receiver locations by using a vertical time shift to a flat datum. A "residual statics correction" may be applied later in processing because the velocity of the near-surface is not initially known.

During "seismic migration," seismic events are geometrically relocated in either space or time to the location the event occurred in the subsurface rather than the location recorded at the surface, thereby creating a more accurate image of the subsurface.

"Seismic attribute analysis" extracts or derives a quantity from seismic data to enhance information more subtle in a traditional seismic image, improving geological or geophysical interpretation of the data. Examples of attributes include mean amplitude, which may delineate bright spots, dim spots, dim-outs, hard-knocks, coherency, and AVO. Attributes that may show the presence of hydrocarbons are called "direct hydrocarbon indicators."

(2) Magnetic Vertical Gradient

In some embodiments, the breach in the basement of the geologic formation may be indicated by a magnetic vertical gradient (MVG). The vertical gradient detects near-surface magnetic sources instead of total magnetic field measurements. Gradiometer surveying may obtain exceptionally detailed data by flying at low altitudes and moderate speeds.

Horizontal magnetic gradients provide detailed near-surface information and help to interpolate data between survey flight lines, especially when the survey target has similar dimensions to the survey line spacing. Both vertical and horizontal gradients are less affected by diurnal changes in the earth's magnetic field than other magnetic survey techniques, so they are suitable for use in areas where significant diurnal activity is expected.

The vertical gradient may be collected using gradiometers, such as a pair of cesium magnetometers with a fixed separation. Cesium magnetometers have very high resolution and exceptional stability. Magnetometer sensors may not be reoriented for flight direction changes. When optically-pumped cesium magnetometers with a sensitivity of 0.005 nanotesla (nT) and real-time digital compensation are used, the overall system resolution may have a resolution of about 0.01 nT. In some embodiments, the magnetometers in the aircraft and in the ground station are identical, ensuring that all magnetometer data sets are equivalent in terms of their sensitivity and noise envelopes. The sampling rate may be adjusted from about 2 Hz to about 10 Hz depending on survey specifications. Navigation and accurate flight path recovery are considerations for high resolution airborne gradiometer surveying. Global positioning system (GPS) integrated into navigation and flight path recovery systems allow for excellent navigation providing an accuracy of better than 1 meter in post-flight recovery.

(iii) Geothermal Gradient Through the Geologic Formation

The geologic formation further comprises a geothermal gradient through the formation.

In some embodiments, the geologic formation may be preselected based on the geologic formation comprising a geothermal gradient through the geologic formation.

Geothermal gradient marks the rate of increasing temperature with respect to increasing depth toward the Earth's interior. Away from tectonic plate boundaries, the geothermal gradient is about 25° C. per km of depth (1° F. per 70 feet of depth) through the crust in most of the world. Highly viscous or partially molten rock at temperatures between 650 to 1,200° C. (1,200-2,200° F.) may be found beneath the Earth's surface at depths of 80 to 100 km (50-60 miles). At this depth within the Earth's solid mantle, heat is transported by advection or material transport, behaving as a viscous fluid over geologic timescales. The geothermal gradient within the bulk of Earth's mantle is about 0.5° C. per km of depth (1° F. per 350 feet). Deeper down, around 3,500 km (2,200 mi) at the Earth's inner core/outer core boundary, the temperature is estimated be about 5375±600° C. (9,710±620° F.). At the center of the Earth, the temperature may be up to about 6,725° C. (12,140° F.) and the pressure may be up to 360 GPa.

Heat flows constantly from its sources within the Earth to the surface. Total heat loss from the Earth is estimated at 44.2 TW ($4.42\times10^{13}$ watts). Mean heat flow is 65 $mW/m^2$ over continental crust and 101 $mW/m^2$ over oceanic crust, and average of about 0.087 $W/m^2$ (compared to 0.03% of solar power absorbed by the Earth), but is much more concentrated in areas where thermal energy is transported toward the crust by convection such as along mid-ocean ridges and mantle plumes. The Earth's crust acts as an insulator, which fluid conduits pierce to release the heat underneath. Heat is also lost through plate tectonics, through mantle upwelling associated with mid-ocean ridges, and by conduction through the lithosphere. Lithospheric conduction mostly occurs at the ocean floor where the crust is thinner and younger than under the continents.

The geothermal gradient may vary with location and may be measured as the bottom open-hole temperature after allowing the drilling fluid to equilibrate. A variation in surface temperature induced by climate changes or the Milankovitch cycle may penetrate below the Earth's surface and produce an oscillation in the geothermal gradient with periods varying from daily to tens of thousands of years, and an amplitude which decreases with depth and having a scale depth of several kilometers.

(iv) Seismographic Dim-Out within the Sedimentary Bed

The geologic formation further comprises a seismographic dim-out within the sedimentary bed. The seismographic dim-out indicates an area of porosity that may be filled with a liquid ore. The ancient ocean sedimentary bed is discussed above at section (I)(b)(i). Use of reflection seismography to detect a seismographic dim-out is discussed above at section (I)(b)(iii)(1).

In some embodiments, the geologic formation may be preselected based on the geologic formation comprising a seismographic dim-out within the sedimentary bed.

(v) Circulation of Water Through the Geologic Formation

The geologic formation further comprises a circulation of water through the geologic formation. The water may be heated by the geothermal gradient and may leach minerals from the geologic formation, forming a liquid ore.

In various embodiments, the breach and circulation may be indicated by seismography, as described above at section (I)(b)(iii)(1).

In an exemplary embodiment, the circulation of water may intersect with the seismographic dim-out.

In some embodiments, the geologic formation may be preselected based on the geologic formation comprising a circulation of water through the geologic formation.

(vi) Other Features

In further embodiments, the geologic formation may further comprise spatial proximity to a mountain front, and the liquid ore may comprise rare earth elements (REEs) in a concentration of at least about 200 mg/L.

In some embodiments, the geologic formation may be preselected based on the geologic formation comprising spatial proximity to a mountain front.

In other embodiments, the geologic formation may be preselected based on the geologic formation comprising a liquid ore comprising rare earth elements (REEs) in a concentration of at least about 200 mg/L.

(II) Methods for Processing a Liquid Ore

Also provided herein is a method for processing a liquid ore. The method comprises (a) contacting a liquid ore with carbon dioxide to form a mixture. In step (b), the mixture of step (a) is contacted with a proton acceptor to form solid magnesium carbonate. In step (c), the solid magnesium carbonate is separated from the mixture of step (b). The liquid ore comprises at least 250 g/L of total dissolved solids, has a pH of 6 or less, and is produced from a well. The well may be (1) located in a geologic formation, comprising (i) an ancient ocean sedimentary bed, (ii) a breach in the basement rock, (iii) a geothermal gradient through the geologic formation, (iv) a seismographic dim-out within the sedimentary bed, and (v) a circulation of water through the geologic formation. Alternatively, the well may be (2) located within the edges of an ancient ocean sedimentary bed containing at least one second well that has produced a second liquid ore, the second liquid ore comprising at least 250 g/L of total dissolved solids and has a pH of 6 or less.

In other embodiments, the well may have the characteristics of both (1) and (2). The liquid ores, wells, and geologic formations are as described above in sections (I)(a), (I)(b), and (I)(c), respectively.

In some embodiments, the method may further comprise producing the liquid ore according a method described above in section (I).

In other embodiments, the well may be located in a geologic formation preselected based on characteristics, such as an ancient ocean sedimentary bed, a breach in the basement rock, a geothermal gradient through the geologic formation, a seismographic dim-out within the sedimentary bed, a circulation of water through the geologic formation, and any combination of the foregoing.

(a) Step (a)—Reaction Mixture

Step A of the process comprises contacting a liquid ore with carbon dioxide to form a mixture. The process commences with the formation of a reaction mixture comprising the liquid ore, which is detailed above, and carbon dioxide.

The carbon dioxide may be from any suitable source, for example in gaseous form from the atmosphere or from the effluent of an industrial process, in liquid form as an aqueous solution of carbonic acid, or in solid form as dry ice.

In particular embodiments, the carbon dioxide may be the effluent from a fossil fuel burning power plant, such as a coal-fired power plant.

The amount of carbon dioxide that is contacted with the liquid ore can and will vary. In general, the mole to mole ratio of Mg in the liquid ore to carbon dioxide may range from about 1:1 to about 1:10, such as from about 1:2 to about 1:5.

In various embodiments, the mole to mole ratio of Mg in the liquid ore to carbon dioxide may be about 1:1, about 1:2, about 1:3, about 1:4, about 1:5, about 1:6, about 1:7, about 1:8, about 1:9, or about 1:10.

In some embodiments, the mole to mole ratio of Mg in the liquid ore to carbon dioxide is greater than 1:1.

In some embodiments, the mole to mole ratio of Mg in the liquid ore to carbon dioxide is less than 1:10.

In general, the solvent is the water present in the liquid ore. The volume to mass ratio of the solvent to carbon dioxide is, in part, a function of the concentration of Mg and/or other components in the liquid ore targeted for reaction with carbon dioxide. As such, the volume to mass ratio of solvent to carbon dioxide is readily understood by one of skill in the art.

(b) Step (a)—Reaction Conditions

In general, the reaction is conducted at a temperature that ranges from about 0° C. to about 100° C.

In various embodiments, the reaction may be conducted at a temperature from about 0° C. to about 20° C., from about 20° C. to about 40° C., from about 40° C. to about 60° C., from about 60° C. to about 80° C., or from about 80° C. to about 100° C.

In one exemplary embodiment, the reaction may be conducted at a temperature from about 20° C. to about 50° C.

In some embodiments, the reaction may be conducted at a temperature greater than 0° C.

In some embodiments, the reaction may be conducted at a temperature less than 100° C.

The reaction may be conducted in an inert atmosphere (e.g., under nitrogen or argon) and under ambient pressure.

Typically, the reaction is allowed to proceed for a sufficient period of time until the reaction is complete, as determined by visual inspection, chromatography (e.g., HPLC) or another suitable method. In this context, a "completed reaction" generally means that the reaction mixture contains a significantly diminished amount of unassociated Mg in the liquid ore, and a significantly increased amount of magnesium carbonate compared to the amounts of each present at the beginning of the reaction. Typically, the amount of Mg remaining in the reaction mixture after the reaction is complete may be less than about 3%, or less than about 1%. In general, the reaction may proceed for about 1 minute to about 4 hours. Typically, the duration of the reaction is longer at lower reaction temperatures.

In certain embodiments, the reaction may be allowed to proceed for about a period of time ranging from about 1 minute to about 5 minutes, from about 5 minutes to about 10 minutes, from about 10 minutes to about 15 minutes, from about 15 minutes to about 30 minutes, from about 30 minutes to about 1 hour, 1 hour to about 2 hours, from about 2 hours to about 3 hours, or from about 3 hours to about 4 hours.

The yield of $MgCO_3$ can and will vary. Typically, the yield of $MgCO_3$ may be at least about 40%.

In one embodiment, the yield of $MgCO_3$ may range from about 40% to about 60%.

In another embodiment, the yield of $MgCO_3$ may range from about 60% to about 80%.

In a further embodiment, the yield of $MgCO_3$ may range from about 80% to about 90%.

In still another embodiment, the yield of $MgCO_3$ may be greater than about 90%, or greater than about 95%.

(c) Step (b)—Reaction Mixture

Step (b) comprises contacting the mixture of step (a) with a proton acceptor to form solid magnesium carbonate. The process commences with forming a reaction mixture comprising the mixture of step (a), as detailed above, with a proton acceptor.

The proton acceptor may be organic or inorganic. In general, the proton acceptor has a pKa of between about 7 and about 13, preferably between about 8 and about 10. Representative proton acceptors that may be employed include, but are not limited to, borate salts (such as, for example, $Na_3BO_3$), di- and tri-basic phosphate salts (such as, for example, $Na_2HPO_4$ and $Na_3PO_4$), bicarbonate salts (such as, for example, $NaHCO_3$, $KHCO_3$, mixtures thereof, and the like), hydroxide salts (such as, for example, NaOH, KOH, mixtures thereof, and the like), carbonate salts (such as, for example, $Na_2CO_3$, $K_2CO_3$, mixtures thereof, and the like), organic bases (such as, for example, pyridine, triethylamine, diisopropylethylamine, N-methylmorpholine, N,N-dimethylaminopyridine, and mixtures thereof), organic buffers (such as, for example, N-(2-acetamido)-2-aminoethane sulfonic acid (ACES), N-(2-acetamido)-iminodiacetic acid (ADA), N,N-bis(2-hydroxyethyl)glycine (BICINE), 3-(cyclohexylamino)-1-propanesulfonic acid (CAPS), 2-(cyclohexylamino) ethanesulfonic acid (CHES), 4-(2-hydroxyethyl)-1-piperazinepropanesulfonic acid (EPPS), 4-(2-hydroxyethyl)piperazine-1-ethanesulfonic acid (HEPES), 2-(4-morpholinyl) ethanesulfonic acid (MES), 4-morpholinepropanesulfonic acid (MOPS), 1,4-piperazinediethanesulfonic acid (PIPES), [(2-hydroxy-1,1-bis(hydroxymethyl) ethyl)amino]-1-propanesulfonic acid (TAPS), 2-[(2-hydroxy-1,1-bis(hydroxymethyl)ethyl)amino] ethanesulfonic acid (TES), salts and/or mixtures thereof, and the like), and combinations thereof.

In exemplary embodiments, the proton acceptor may be selected from the group consisting of sodium bicarbonate, potassium hydroxide, sodium hydroxide, ammonium hydroxide, and ammonia.

In some embodiments, the proton acceptor may be obtained from flyash, for example from a coal-fired power plant.

The amount of proton acceptor that is contacted with the liquid ore can and will vary. In general, the mole to mole ratio of Mg in the liquid ore to proton acceptor may range from about 1:0.1 to about 1:10, such as from about 1:1 to about 1:2.

In various embodiments, the mole to mole ratio of Mg in the liquid ore to proton acceptor may be about 1:0.1, about 1:0.5, 1:1, about 1:2, about 1:3, about 1:4, about 1:5, about 1:6, about 1:7, about 1:8, about 1:9, or about 1:10.

In certain embodiments, the amount of proton acceptor may be sufficient to increase the pH of the mixture of step (a) to the range of about 6.6 to about 7.0.

In general, the solvent is the water present in the liquid ore. The volume to mass ratio of the solvent to proton acceptor is, in part, a function of the concentration of Mg and/or other components in the liquid ore targeted for precipitation. As such, the volume to mass ratio of solvent to carbon dioxide is readily understood by one of skill in the art.

(d) Step (b)—Reaction Conditions

In general, the reaction is conducted at a temperature that ranges from about 0° C. to about 100° C.

In various embodiments, the reaction may be conducted at a temperature from about 0° C. to about 20° C., from about 20° C. to about 40° C., from about 40° C. to about 60° C., from about 60° C. to about 80° C., or from about 80° C. to about 100° C.

In one exemplary embodiment, the reaction may be conducted at a temperature from about 20° C. to about 50° C.

The reaction may be conducted in an inert atmosphere (e.g., under nitrogen or argon) and under ambient pressure.

Typically, the reaction is allowed to proceed for a sufficient period of time until the reaction is complete, as determined by visual inspection, chromatography (e.g., HPLC) or another suitable method. Typically, the amount of $MgCO_3$ remaining in the reaction mixture after the reaction is complete may be less than about 3%, or less than about 1%. In general, the reaction may proceed for about 1 minute to about 4 hours. Typically, the duration of the reaction is longer at lower reaction temperatures.

In certain embodiments, the reaction may be allowed to proceed for about a period of time ranging from about 1 minute to about 5 minutes, from about 5 minutes to about 10 minutes, from about 10 minutes to about 15 minutes, from about 15 minutes to about 30 minutes, from about 30 minutes to about 1 hour, 1 hour to about 2 hours, from about 2 hours to about 3 hours, or from about 3 hours to about 4 hours.

The yield of solid $MgCO_3$ can and will vary. Typically, the yield of solid $MgCO_3$ may be at least about 40%.

In one embodiment, the yield of solid $MgCO_3$ may range from about 40% to about 60%.

In another embodiment, the yield of solid $MgCO_3$ may range from about 60% to about 80%.

In a further embodiment, the yield of solid $MgCO_3$ may range from about 80% to about 90%.

In still another embodiment, the yield of solid $MgCO_3$ may be greater than about 90%, or greater than about 95%.

In some embodiments, the process may further comprise forming solid calcium carbonate ($CaCO_3$) formed before step (b). In these embodiments, the amount of proton acceptor is selected to precipitate $CaCO_3$ but not precipitate a substantial amount of $MgCO_3$. Following isolation of solid $CaCO_3$ from the reaction mixture, additional proton acceptor may be added to effect precipitation of solid $MgCO_3$, as detailed above.

(e) Step (c)

Step (c) of the process commences with separating the solid magnesium carbonate is separated from the mixture of step (b). Non-limiting examples of suitable techniques include precipitation, extraction, evaporation, distillation, chromatography, and crystallization.

In certain embodiments, once solid $MgCO_3$ precipitates or crystallizes, the material may be isolated by one or more techniques, for example surface filtration, gravity separation, and centrifugation.

"Surface filtration" refers to use of a solid sieve which traps solid particles with or without the aid of filter paper, for example a Büchner funnel, belt filter, rotary vacuum-drum filter, crossflow filter, or screen filter. A "depth filter" refers to a bed of granular material which retains the solid particles as it passes, for example sand, silica gel (kieselguhr), cellulose, perilite, or diatomaceous earth (celite). Filter media may be cleaned by rinsing with solvents or detergents, backwashing, or self-cleaning using point-of-suction backwashing without interrupting system flow. Fluids may filter by gravity, by vacuum on the filtrate (bottom) side of the filter (vacuum filtration), or by pressure added to the precipitate (top) side of the filter. Filtration by gravity is a form of gravity separation.

"Gravity separation" refers to separating two components from a suspension or homogeneous mixture by using gravity as the dominant force. Often other methods, such as flocculation, coagulation and vacuum filtration, are faster and more efficient than gravity separation, but gravity separation may be more cost effective. Examples of gravity separation include, but not limited to, preferential floating, clarification, thickening, and centrifugation. Heavy liquids, such as tetrabromoethane, may be used to solids by preferential flotation. "Clarification" refers to separating fluid from solid particles, often used along with flocculation to make the unwanted solid particles sink faster to the bottom of a pool than the desired fluid. Thickening is clarification in reverse: Desired solids sink to the bottom and unwanted fluid to the surface.

"Centrifugation" refers to a process involving centrifugal force to separate mixtures. Denser components of the mixture migrate away from the axis of the centrifuge, while less dense components migrate toward the axis. The rate of centrifugation is specified by the acceleration applied to the material targeted for separation, typically measured in revolutions per minute (rpm) or gravitational force (g-force, g), which corresponds to about 9.8 $m/s^2$. Spinning may occur, for example at least about 1,000 rpm, such as at least about 5,000 rpm, at least about 10,000 rpm, at least about 30,000 rpm, or at least about 70,000 rpm.

The method may further comprise drying the solid magnesium carbonate. In general, drying may be conducted at a temperature that ranges from about 90° C. to about 200° C.

In various embodiments, the reaction may be conducted at a temperature from about 90° C. to about 100° C., from about 100° C. to about 125° C., from about 125° C. to about 150° C., or from about 150° C. to about 200° C.

In some embodiments, a drying system may be used to dry the solid $MgCO_3$. The solid $MgCO_3$ may be, for example, dried to about 1 wt. % to about 15 wt. % of water, such as about 5 wt. % to about 15 wt. %, about 10 wt. % to about 15 wt. %, about 1 wt. % to about 2 wt. %, about 2 wt. % to about 3 wt. %. about 3 wt. % to about 6 wt. %, about 3 wt. % to about 4 wt. %, about 4 wt. % to about 5 wt. %, about 5 wt. % to about 6 wt. %, about 6 wt. % to about 7 wt. %, about 7 wt. % to about 8 wt. %, about 8 wt. % to about 9 wt. %, about 9 wt. % to about 10 wt. %, about 10 wt. % to about 11 wt. %, about 11 wt. % to about 12 wt. %, about 12 wt. % to about 13 wt. %, about 13 wt. % to about 14 wt. %, or about 14 wt. % to about 15 wt. %.

In some embodiments, the drying system may use waste heat from a generator set, industrial boiler, or other process to augment heat supplied directly to the drying system.

(f) Further Steps

The process may comprise further steps, for example, to form magnesium oxide, to form magnesium metal, or to precipitate further solids.

(i) Forming Magnesium Oxide (MgO)

The method may further comprise heating the solid $MgCO_3$ to form magnesium oxide (MgO), for example by heating solid $MgCO_3$ in horizontal rotary kilns, normally by direct firing with oil or gas. Grades with a very low sulfate content may be obtained by heating with wood. The temperature and duration of the calcination procedure may determine the reactive properties (grades) of the MgO. In general, the calcination reaction is conducted at a temperature that ranges from about 400° C. to about 2,000° C.

In various embodiments, the calcination reaction may be conducted at a temperature from about 400° C. to about 600° C., from about 600° C. to about 800° C., from about 800° C. to about 1,000° C., from about 1,000° C. to about 1,200° C., from about 1,200° C. to about 1,400° C., from about 1,400° C. to about 1,600° C., from about 1,600° C. to about 1,800° C., or from about 1,800° C. to about 2,000° C.

Decomposition of magnesium carbonate to form magnesium oxide and carbon dioxide begins at a temperature slightly above 400° C., according to reaction (1):

$$MgCO_3(s) \rightarrow MgO(s) + CO_2(g) \quad (1)$$

Calcination temperatures of between 500° C. and 1,000° C. may produce MgO with a relatively high specific surface area and relatively high chemical reactivity, referred to as "caustic calcined magnesite" or "causter." These MgO materials may react readily with water and may react fairly vigorously with dilute acid solutions in water. In contrast, calcining at temperatures above 1,600° C. produces dead burnt magnesite, also referred as "sinter" or "sinter magnesite," a MgO with extremely low reactive properties principally used in iron foundries as a refractory material.

Alternatively, solid $MgCO_3$ and $CaCO_3$ may be separated using calcination, hydration, and reprecipitiation by following, for example, the Pattinson process described below in equations (2)-(6).

First, a mixture of MgO and calcium oxide (CaO) is produced by calcining at a temperature of at least 1000° C., according to reaction (2):

$$CaCO_3+MgCO_3 \rightarrow MgO+CaO+2CO_2 \quad (2)$$

These light burnt oxides are hydrated to form the calcium and magnesium hydroxides, according to reaction (3):

$$CaO+MgO+2H_2O \rightarrow Ca(OH)_2+Mg(OH)_2 \quad (3)$$

The carbon dioxide produced by reaction (2) may be used to carbonate the hydroxide mixture. By selecting appropriate reaction conditions, calcium carbonate may be precipitated, according to reaction (4):

$$Ca(OH)_2+CO_2 \rightarrow CaCO_3+H_2O \quad (4)$$

With a higher carbon dioxide pressure the soluble magnesium bicarbonate ($Mg(HCO_3)_2$) may be formed, according to reaction (5):

$$Mg(OH)_2+2CO_2 \rightarrow Mg(HCO_3)_2 \quad (5)$$

After separation of solid calcium carbonate from the $Mg(HCO_3)_2$ solution, carbon dioxide may be selectively released by raising the temperature of the solution to about 100° C. Insoluble magnesium hydroxide carbonate (nesquehonite) then precipitates and may be extracted, according to reaction (6):

$$5Mg(HCO_3)_2 \rightarrow 4MgCO_3.Mg(OH)_2.4H_2O+6CO_2 \quad (6)$$

Carbon dioxide generated in reaction (6) may be fed back into the reactions (4) and (5). The nesquehonite extracted in this way may be directly calcined to MgO. Nesquehonite represents only one of a variety of possible compositions, and the quality of nesquehonite formed depends on the procedure followed. This process typically produces grades with a low apparent density.

Solid MgO may be ground. Grinding may be performed in hammer, ball, jet, or pendulum mills, which are made of abrasive-proof materials or coated with rubber to prevent contamination of the MgO. Particles of different sizes may be obtained. In some applications, wet grinding may be used followed by recalcination; that is, heating the solid MgO to calcination temperatures for a second time.

(ii) Forming Magnesium Metal

Magnesium metal)($Mg^0$) may be obtained by using electrolysis of magnesium chloride ($MgCl_2$) from liquid ore or of solid MgO, or by using a silicothermic reduction, such as the Pidgeon process, on solid MgO or solid $MgCO_3$. In particular, the method may further comprise contacting the solid $MgCO_3$ with a $Si^0$-containing compound, such as a ferrosilicon alloy, to form $Mg^0$.

In the electrochemical process using $MgCl_2$, $Mg^{2+}$ is reduced at the cathode by two electrons to $Mg^0$, and each pair of $Cl^-$ is oxidized at the anode to chlorine gas ($Cl_2$), releasing two electrons to complete the circuit. Alternatively, the electrolytic reduction of MgO reduces $Mg^{2+}$ at the cathode by two electrons to $Mg^0$. The electrolyte may be yttria-stabilized zirconia (YSZ). The anode may be a liquid metal.

At the YSZ/liquid metal anode, $O^{2-}$ is reduced to oxygen gas ($O_2$). A layer of graphite borders the liquid metal anode, and at this interface carbon and oxygen may react to form carbon monoxide (CO). When silver (Ag) is used as the liquid metal anode, no reductant carbon or hydrogen is needed, and only $O_2$ is evolved.

In the silicothermic Pidgeon process, MgO or $MgCO_3$ may be reduced with silicon)($Si^0$) at high temperatures to form magnesium metal vapor, according to reaction (7):

$$Si^0(s)+2MgO(s) \leftrightarrows SiO_2(s)+2Mg^0(g) \quad (7)$$

The $Mg^0$ vapor deposits to form high purity magnesium crowns, which may be remelted and cast into ingots. The atmospheric pressure boiling point of $Mg^0$ is comparatively low, only 1,090° C., and even lower under vacuum.

In some embodiments, the $Si^0$-containing compound may be a ferrosilicon alloy, $Fe_xSi_y$, where x and y are each non-negative integers. In some embodiments, the number x may range from 1 to 12, for example from 4 to 8, or 1, 2, 3, 4, 5, 7, 8, 9, 10, 11, or 12. In some embodiments, x is less than 12. In some other embodiments, x is greater than 1. The number y may range from 1 to 12, for example from 4 to 8, or 1, 2, 3, 4, 5, 7, 8, 9, 10, 11, or 12. In some embodiments, y is less than 12. In some other embodiments, y is greater than 1.

Generally, raw materials may be calcined to remove water and carbon dioxide, which are gaseous at reaction temperatures and entrain within the $Mg^0$ vapor. In some instances, MgO may be obtained directly from a mineral source. In other instances, $MgCl_2$ may be hydrolyzed to $Mg(OH)_2$, which is then calcined to MgO by removal of water. In still other instances, mined magnesite may be calcined to MgO by carbon dioxide removal. In yet other instances, an aqueous solution of $MgCl_2$ may be treated with $CO_2$ to form $MgCO_3$, which may then be calcined to from MgO. Often, dolomite may be used. The calcium oxide from the dolomite may scavenge the silica formed in the reaction zone, releasing heat and consuming some of the silica reaction product, thus driving the equilibrium toward the products, according to reactions (8, dolomite calcination), (9, magnesium reduction), and (10, silica scavenging):

$$(Ca,Mg)CO_3(s) \rightarrow CaO.MgO(s)+CO_2(g) \quad (8)$$

$$(Fe_xSi_y)(s)+MgO(s) \leftrightarrows Fe^0(s)+SiO_2(s)+Mg^0(g) \quad (9)$$

$$CaO+SiO_2 \rightarrow CaSiO_3 \quad (10)$$

In a particular embodiment, the Pidgeon process may be a batch process in which finely powdered calcined dolomite and ferrosilicon alloy are mixed, briquetted, and charged into nickel-chrome-steel retorts. The hot reaction zone portion of the retort may be gas-fired, coal-fired, or electrically heated, and may use waste heat from a generator set, industrial broiler, or other source to augment heat supplied directly to the retort. The condensing section may be equipped with removable baffles that extend from the furnace.

(iii) Precipitating Further Solids

The method may further comprise contacting the mixture of step (c) with a second proton acceptor to form a second solid. One of skill in the art would understand how to select the second proton acceptor and the concentration of the second proton acceptor to effect precipitation of a second solid from the liquid ore.

DEFINITIONS

When introducing elements of the present disclosure or the preferred embodiments(s) thereof, the articles "a", "an", "the" and "said" are intended to mean that there are one or more of the elements. The terms "comprising", "including"

and "having" are intended to be inclusive and mean that there may be additional elements other than the listed elements.

"Barrel," "oil barrel," or "bbl" refers to unit of volume equal to 42 U.S. gallons (about 158.987 liters). "Mbbl" refers to 1,000 barrels or 42,000 gallons. "MMbbl" refers to 1,000,000 barrels or 42,000,000 gallons.

"Barrels per day" (bbl/d, Mbbl/d, or MMbbl/d) refers to a rate of production equivalent to 0.0292 gallons per minute. In the oilfield, rates of production of different fluids may be differentiated. For example, if a well produces 10 Mbbl/d of fluids with a 20% water cut, then the well producing 8 Mbbl/d of oil and 2 Mbbl/d of water.

"Effluent" refers to an outflowing of liquid or gas from a natural or manmade assemblage or structure.

"Influent" refers to an inflowing of liquid or gas into a natural or manmade assemblage or structure.

"Lixiviant" is a liquid medium used in hydrometallurgy to selectively extract a desired metal from the ore or mineral, assisting in rapid and complete leaching. The metal can be recovered from it in a concentrated form after leaching. A common example of a lixiviant is sulfuric acid.

Having described the disclosure in detail, it will be apparent that modifications and variations are possible without departing from the scope of the disclosure defined in the appended claims.

EXAMPLES

The following examples are included to demonstrate certain embodiments of the disclosure. It should be appreciated by those of skill in the art that the techniques disclosed in the examples represent techniques discovered by the inventors to function well in the practice of the disclosure. Those of skill in the art should, however, in light of the present disclosure, appreciate that many changes can be made in the specific embodiments that are disclosed and still obtain a like or similar result without departing from the spirit and scope of the disclosure, therefore all matter set forth is to be interpreted as illustrative and not in a limiting sense.

Example 1

Method for Recovering Precious Metals from Liquid Ore

Using a clean 5-gallon container, 16 liters of liquid ore are added and stirred for 30 minutes with 3-5 drops of Triton™ X-100 (a non-toxic, nonionic surfactant manufactured by Rohm & Haas). Under continual stirring, 75 grams of commercial filter-grade diatomaceous earth is added and allowed to stir for 30 more minutes before letting let mixture rest for about an hour. The supernatant is decanted and reserved for further processing, if desired. The solid material is concentrated on a pan and visually examined under a microscope to identify features of gold, silver, or platinum group metals.

The solid is placed in beaker and while stirring, the pH is lowered to about 4 or 5 with HCl. After a few minutes, the pH is raised to about 9 with VenMet™, a reducing agent consisting of a dispersion of sodium borohydride in sodium hydroxide, manufactured by Rohm & Haas. After about 15 to 30 minutes, the mixture is vacuum filtered, washed with water, and dried at about 300° C. The dried solid may be assayed using conventional methods such as fire assay or inductively coupled plasma atomic emission spectroscopy (ICP/AES).

What is claimed is:

1. A method for producing liquid ore, the method comprising:

producing a liquid ore from a well in a geologic formation, wherein the liquid ore comprises at least 250 g/L of total dissolved solids and has a pH of 6 or less; and wherein the geologic formation comprises:

(i) an ancient ocean sedimentary bed, (ii) a breach in a basement rock, (iii) a geothermal gradient through the geologic formation, (iv) a seismographic dim-out within the sedimentary bed, and (v) a circulation of water through the geologic formation.

2. The method of claim 1, wherein the geologic formation is preselected using the characteristics of the geologic formation comprising:

(i) an ancient ocean sedimentary bed, (ii) a breach in a basement rock, (iii) a geothermal gradient through the geologic formation, (iv) a seismographic dim-out within the sedimentary bed, and (v) a circulation of water through the geologic formation.

3. The method of claim 1, further comprising drilling the well in the geologic formation before producing the liquid ore.

4. The method of claim 1, wherein the liquid ore comprises at least 10,000 mg/L Mg.

5. The method of claim 4, wherein the liquid ore comprises at least 20,000 mg/L Mg.

6. The method of claim 1, wherein the liquid ore has a pH of 5 or less.

7. The method of claim 1, wherein the breach and circulation are indicated by seismography.

8. The method of claim 1, wherein the breach is indicated by a magnetic vertical gradient.

9. The method of claim 1, wherein the circulation of water intersects with the seismographic dim-out.

10. The method of claim 1, wherein the geologic formation further comprises spatial proximity to a mountain front, and the liquid ore comprises rare earth elements in a concentration of at least 200 mg/L.

11. The method of claim 1, wherein the ancient ocean sedimentary bed contains at least one second well that has produced a second liquid ore, the second liquid ore comprising at least 250 g/L of total dissolved solids and having a pH of 6 or less.

12. A method for producing liquid ore, the method comprising:

producing a liquid ore from a well in a geologic formation;

wherein the liquid ore comprises at least 250 q/L of total dissolved solids and has a pH of 6 or less; and wherein the well is located within an ancient ocean sedimentary bed containing at least one second well that has produced a second liquid ore, the second liquid ore comprising at least 250 q/L of total dissolved solids and has a pH of 6 or less, wherein the ancient ocean sedimentary bed is part of a geologic formation, the geologic formation further comprising:

(i) a breach in a basement rock, (ii) a geothermal gradient through the geologic formation, (iii) a seismographic dim-out within the sedimentary bed, and (iv) a circulation of water through the geologic formation.

13. The method of claim 12, wherein the geologic formation is preselected using the characteristics of the geologic formation comprising:

(i) an ancient ocean sedimentary bed, (ii) a breach in a basement rock, (iii) a geothermal gradient through the geologic formation, (iv) a seismographic dim-out within the sedimentary bed, and (v) a circulation of water through the geologic formation.

14. A method for processing a liquid ore, the method comprising:

(a) contacting a liquid ore with carbon dioxide to form a mixture;

(b) contacting the mixture of step (a) with a proton acceptor to form solid magnesium carbonate; and (c) separating the solid magnesium carbonate from the mixture of step (b);

wherein the liquid ore comprises at least 250 g/L of total dissolved solids, has a pH of 6 or less, and is produced from a well, wherein the well is:

(1) located in a geologic formation, comprising:

(i) an ancient ocean sedimentary bed, (ii) a breach in a basement rock, (iii) a geothermal gradient through the geologic formation, (iv) a seismographic dim-out within the sedimentary bed, and (v) a circulation of water through the geologic formation; or (2) located within an ancient ocean sedimentary bed containing at least one second well that has produced a second liquid ore, the second liquid ore comprising at least 250 g/L of total dissolved solids and has a pH of 6 or less; or (3) both (1) and (2).

15. The method of claim 14, further comprising producing the liquid ore according the method claim 1 prior to processing the liquid ore.

16. The method of claim 14, further comprising forming solid calcium carbonate before step (b).

17. The method of claim 14, wherein the proton acceptor is selected from the group consisting of sodium bicarbonate, potassium hydroxide, sodium hydroxide, ammonium hydroxide, and ammonia.

18. The method of claim 14, wherein the amount of proton acceptor is sufficient to increase the pH of the mixture of step (a) to the range of 6.6 to 7.0.

19. The method of claim 14, wherein the proton acceptor is obtained from flyash.

20. The method of claim 19, further comprising heating the solid magnesium carbonate to form magnesium oxide.

21. The method of claim 14, further comprising drying the solid magnesium carbonate.

22. The method of claim 21, further comprising contacting the solid magnesium carbonate with a $Si^0$-containing compound to form $Mg^0$.

23. The method of claim 22, wherein the $Si^0$-containing compound is a ferrosilicon alloy.

24. The method of claim 14, further comprising contacting the mixture of step (c) with a second proton acceptor to form a second solid.

25. The method of claim 14, wherein the carbon dioxide is the effluent from a fossil fuel burning power plant.

* * * * *